US012370432B2

(12) United States Patent
Sinek

(10) Patent No.: US 12,370,432 B2
(45) Date of Patent: Jul. 29, 2025

(54) SKATE GUARD

(71) Applicant: Rockerz Skatewear LLC, Emeryville, CA (US)

(72) Inventor: Charles Sinek, Emeryville, CA (US)

( * ) Notice: Subject to any disclaimer, the term of this patent is extended or adjusted under 35 U.S.C. 154(b) by 0 days.

(21) Appl. No.: 18/454,297

(22) Filed: Aug. 23, 2023

(65) Prior Publication Data

US 2025/0065214 A1 Feb. 27, 2025

(51) Int. Cl.
*A63C 3/12* (2006.01)

(52) U.S. Cl.
CPC ..... *A63C 3/12* (2013.01)

(58) Field of Classification Search
CPC ..... A63C 3/12
See application file for complete search history.

(56) References Cited

U.S. PATENT DOCUMENTS 4,264,090 A * 4/1981 Davies ..... A63C 3/12 280/825
4,382,616 A * 5/1983 Olivieri ..... A63C 3/12 280/825
4,392,674 A * 7/1983 Evon ..... A63C 3/12 280/825
5,513,881 A * 5/1996 DiMeglio ..... A63C 3/12 280/825
5,941,568 A * 8/1999 White, II ..... A63C 3/12 D21/772
D618,755 S * 6/2010 Handra ..... D21/772
D619,185 S * 7/2010 Handra ..... D21/772
D665,646 S 8/2012 Handra et al.
8,646,809 B2 * 2/2014 Lee ..... A63C 3/12 280/825
8,764,065 B2 * 7/2014 Kimball ..... A63C 17/002 280/811
11,660,523 B2 * 5/2023 Merlo ..... A63C 3/12 280/825
2007/0075540 A1 * 4/2007 Steinhauser, Jr. ..... A63C 3/12 280/825

OTHER PUBLICATIONS

Ice Skating Passion; "The figure skate blades (styles, profiles, tips to choose, brands)"; retrieved on Apr. 24, 2023 from https://iceskatingpassion.com.
API Solution; "Glossary of Plastic Injection Molding Terms"; retrieved on Jul. 20, 2023 from https://www.apisolution.com/downloads/glossary_plastic_injection_molding_engineering_manufacturing.pd.
Skaters Landing; "All About Blades: A Basic Guide"; retrieved on Apr. 24, 2023 from https://skaterslanding.com.

* cited by examiner

*Primary Examiner* — Jeffrey J Restifo
(74) *Attorney, Agent, or Firm* — Robert H. Frantz

(57) ABSTRACT

An improved skate blade guard having one or more improvements of a Y-shaped blade receiving channel, drains for conducting melted ice out of the blade receiving channel, voids or slots that perform as shock absorbers and cushions during walking in the skate guards, an improved pick guard, improved manufacturability using exterior shape sculpting to promote even and consistent flow of molten resin during injection molding, and a tread that conforms to the curved shape of some skate blades.

8 Claims, 12 Drawing Sheets
(1 of 12 Drawing Sheet(s) Filed in Color)

*Prior Art*

SKATE GUARD

INCORPORATION BY REFERENCE

U.S. Design Patents D618,755, issued on Jun. 29, 2010; D619,185 S, issued Jul. 6, 2010; and D665,646, issued Aug. 21, 2012, all to Beata Handra and Charles Sinek, are incorporated by reference in their entireties, including diagrams, into the present patent application.

FIELD OF THE INVENTION

The present invention relates to guards to protect blades of ice skates.

BACKGROUND OF THE INVENTION

Ice skates are well known for sport and recreation, including a variety of shoe, boot and blade designs for leisure, learning, dancing, racing, and hockey. Ice skate blades are generally made of plates of metal which have been shaped and sharpened using a grinder to achieve certain desired performance objectives. FIG. 8 provides a generalized depiction of an ice skate 600, which includes an item of footwear (boot, show, etc.), and a blade 601. For general reference, most blades have several sections, portions or components, including a runner 800, a pick or brake 804 at a front end, with a spin rocker curve and a rocker curve 803 and 801 which engage the ice surface. A tail 802 provides the back end of the runner 800, and a stanchion 805 provides vertical support between the heel of the footwear and a heel plate (not visible, but at the top of the stanchion). A similar toe plate under the toe of the footwear connects the front vertical supports at the front end of the blade.

When a user of an ice skate is off the ice and walking on another surface type, such as concrete, wood, carpet, foam, rubber or tile, the user often attaches a skate guard to the bottom edges of the blade to protect the blade from damage and dulling, and to protect the floor surface from the sharpened edges of the skates.

SUMMARY OF THE INVENTION

An improved skate blade guard is disclosed having one or more improvements of a Y-shaped blade receiving channel, drains for conducting melted ice out of the blade receiving channel, voids or slots that perform as shock absorbers and cushions during walking in the skate guards, an improved pick guard, improved manufacturability using exterior shape sculpting to promote even and consistent flow of molten resin during injection molding, and a tread that conforms to the curved shape of some skate blades.

BRIEF DESCRIPTION OF DRAWINGS

The patent or application file contains at least one drawing executed in color. Copies of this patent or patent application publication with color drawing(s) will be provided by the Office upon request and payment of the necessary fee. The figures presented herein, when considered in light of this description, form a complete disclosure of one or more embodiments of the invention, wherein like reference numbers in the figures represent similar or same elements or steps.

DETAILED DESCRIPTION

The present inventor(s) have improved upon the known structures, mechanisms and design of guards for attaching to the runner portion of ice skate blades to protect the edges of the blades and the non-ice surfaces upon which a wearer may walk. The present inventors have previously disclosed in U.S. Design Patents D618,755; D619,185 S; and D665,646 a two-piece skate guard in which a front portion and a rear portion are attached to each other by a pair of stretchable springs such that the two portions can be attached to a blade by hooking a first end of the guard, such as a toe end, onto the blade, and then stretching the guard lengthwise to attach a second end, such as the heel end, and releasing such that the spring draws the two portions together, securely latching it onto the blade. Further, the interior of the previously-disclosed skate guards were provided with a V-shaped channel for receiving the skate blade and securing it by a friction fit.

Another unique aspect about the previously-disclosed designs was a method for providing a universal fit using only one common component. The single component could be used as a front portion or a back portion, in pairs to create a complete guard. To size a guard for a larger (longer) or smaller (shorter) skate size, a cutter device was provided which allowed a technician to cut one or both of the components at their interconnection end, and then to assemble the sized components together using to springs in side channels and fasteners.

Still another unique aspect about the previously-disclosed designs was the ability to use two components fabricated in different colors to create a single guard, so that a user could personalize the guard with a wide number of color combinations to help the distinguish their guards from those of other skaters on the same team or in the same class, and to provide consumer affinity to the product.

Over the years since these previously-disclosed designs were put into production and they have become very widely used and enjoyed, the present inventors have observed how they are used and how they operate in broad practice. The following disclosure provides one or more improvements to the previously-disclosed designs, mechanisms and components to further increase the foregoing objectives and benefits of the product as well as to provide additional objectives and benefits which will be evident in the following paragraphs. The present improvements may be utilized in the previously-disclosed two-piece spring loaded designs, as well as in other designs having a single-piece fabricated to a specific skate size and in multi-piece designs of more than two guard components.

Figure 1:
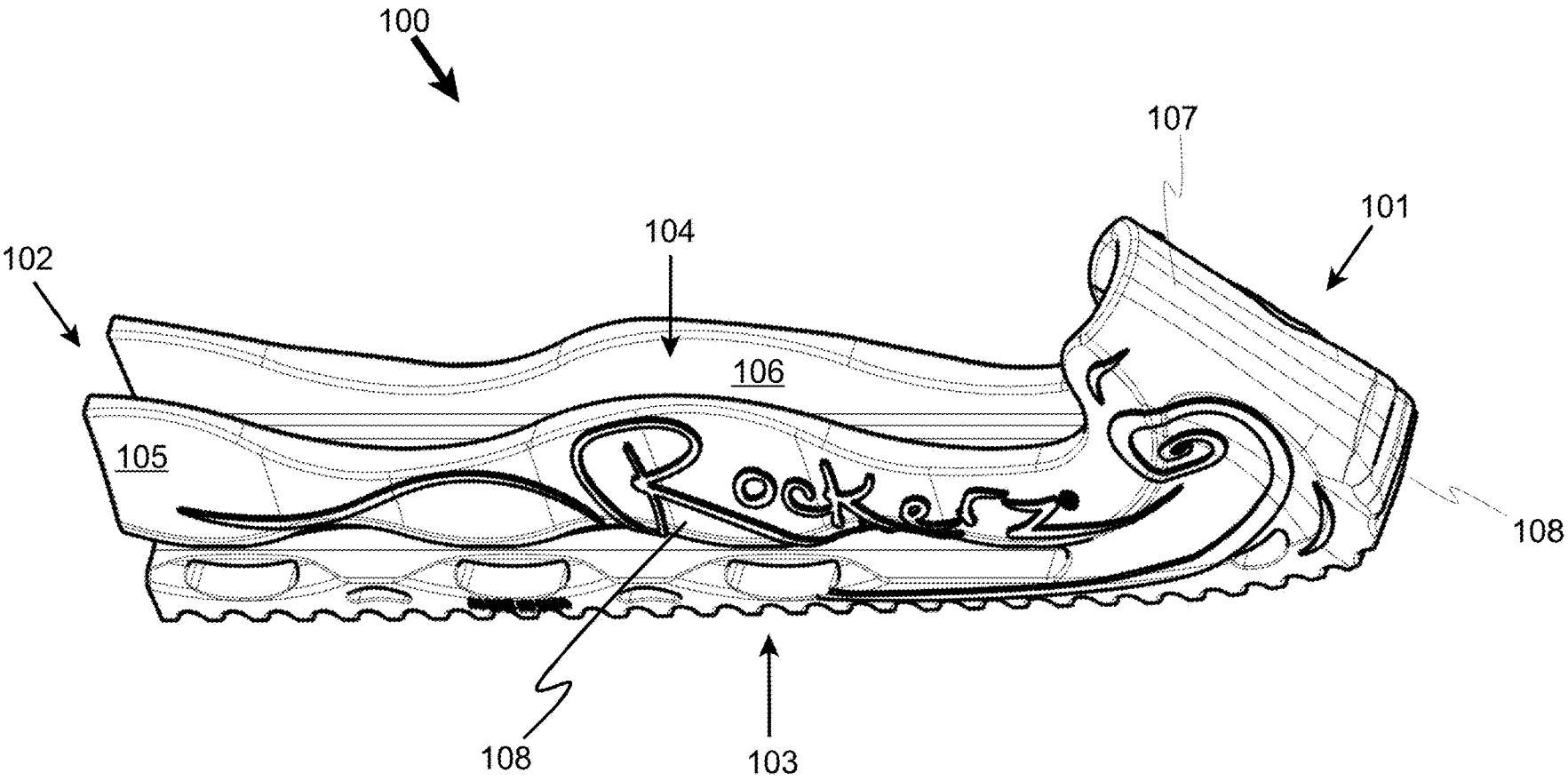
FIG. 1 provides a perspective view of an example embodiment according to the present invention of a skate guard component.

Referring now to FIG. 1, an example embodiment of a skate guard component 100 according to the present design is shown in a perspective view taken slightly from above the skate guard component to reveal a top opening of a skate blade receiving channel 104. The skate guard component 100 has a distal end 101, a proximal end 102, and a bottom 103. The skate blade receiving channel 104 is defined between a first side 105 and a second side 106, which are disposed approximately parallel to each other, extending from the bottom 103 upwards, and from the distal end 101 to the proximal end. Decorative shapes, embossments, debossments, paints, colors, symbols and indiciate 109 may be provided to identify the product brand, model, size, and/or include affinity statements.

The distal end 101 is provided with a pick guard which, in this example embodiment, comprises a rounded lower tip 108 and a distal wall 107 that slopes back towards the proximal end 102 from the lower tip 108 as it rises, with a similar shape being provided on the interior of the distal wall 107 to capture an end (toe or heel) of the blade when attached.

Figure 2:
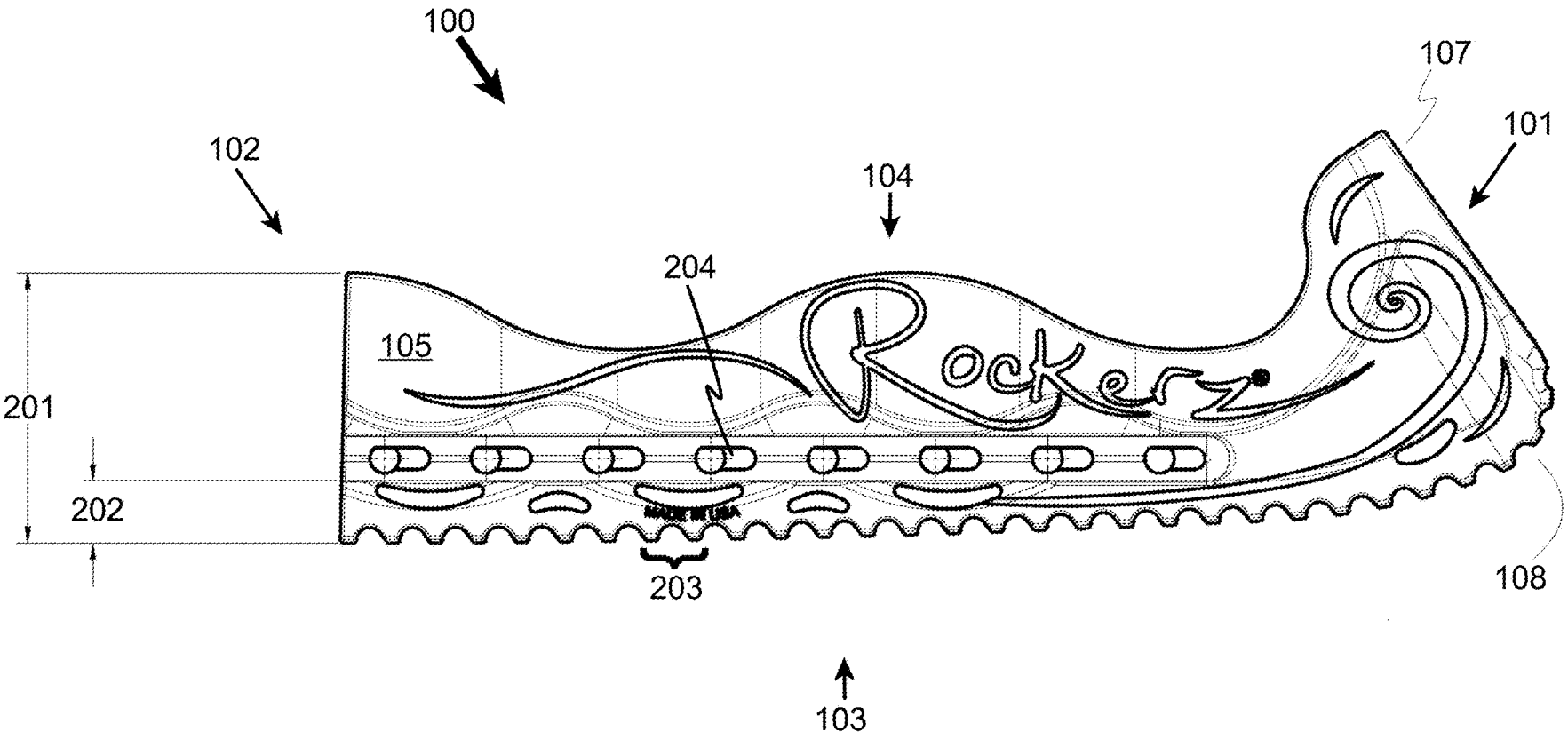
FIG. 2 shows a side view of an example embodiment according to the present invention.

Turning to FIG. 2, a side view taken from the first side 105 perspective is shown of the guard component 100. From this view, the bottom 103 is provided with a plurality of tread shapes 203, such as a plurality of crosswise semi-circular indentations according to this example embodiment, to allow for flexing and bending of the guard component 100 to match the curvature of a blade when attached. Further, such tread shapes 203 provide secure footing for the user when walking on non-ice surfaces. As in the previously-disclosed designs, a plurality of spring attachment points 204 are provided within a channel for receiving the horizontal springs that stretch and retract two components longitudinally. In this particular example embodiment, the tread shapes 203 comprise 0.15" radius indentations separated by about 0.08" protrusions, the height 202 of the tread portion is about 0.36", and the height 201 of the proximal end 102 is about 1.57". Other shapes and dimensions are available within the spirit and scope of the present invention.

Figure 3:
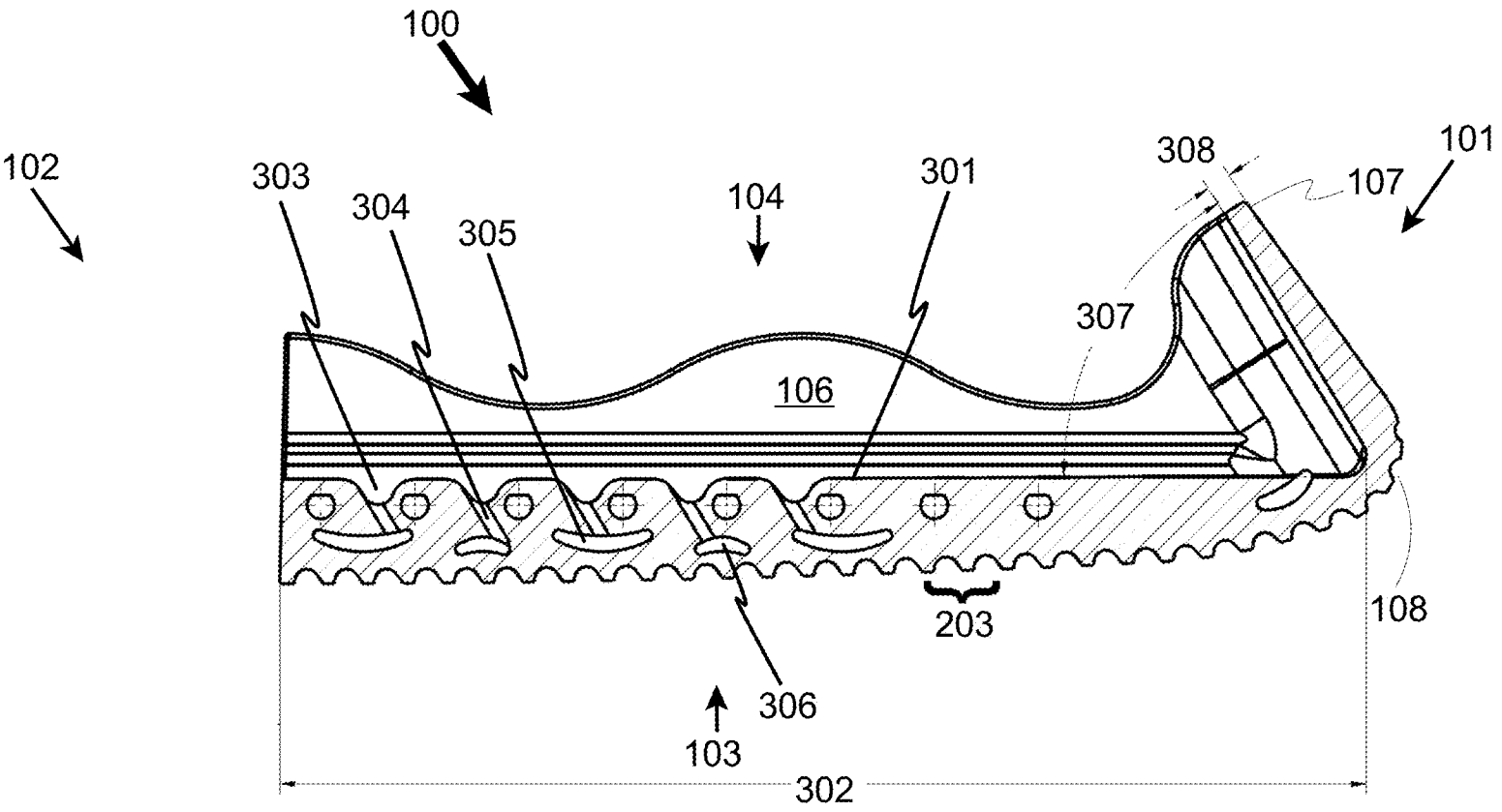
FIG. 3 illustrates a longitudinal cut-away view of an example embodiment according to the present invention.

FIG. 3 shows a cut-away view of the example embodiment component 100 of FIG. 2, taken along a longitudinal mid-point to reveal internal features of at least one present improvement. In this view, the tread portion is generally solid in form, such as molded plastic, and it is provided with unique drains that are both functional and decorative. At the bottom of the Y-channel which receives the blade is a surface 301 which the bottom edge of the runner engages, and upon which the weight of the skater is received. In this improvement, a plurality of drains 303, 304 and drain vents 305, 306 are provided. In this example embodiment according to the present invention, the drain has a top recess 303 for collecting clumps of ice, and a channel 304 which provides fluid communication from the top recess 303 to the vents 305 for melted ice water to escaped downward and out the sides. In this particular embodiment, the internal Y-channel length 302 is about 6.80" which, when paired with another uncut similar component, provides accommodation to receive a blade of up to 13.60". By cutting a section from the proximal end of one or both components, the guard can be shortened to fit a wide variety of blades of less than 13.60" in length. Other shapes and dimensions are available within the spirit and scope of the present invention.

Also shown in FIG. 3 is a slope 307 of the distal wall 107 at an angle of about 59 degrees, according to this particular example embodiment of the present invention.

Figure 4:
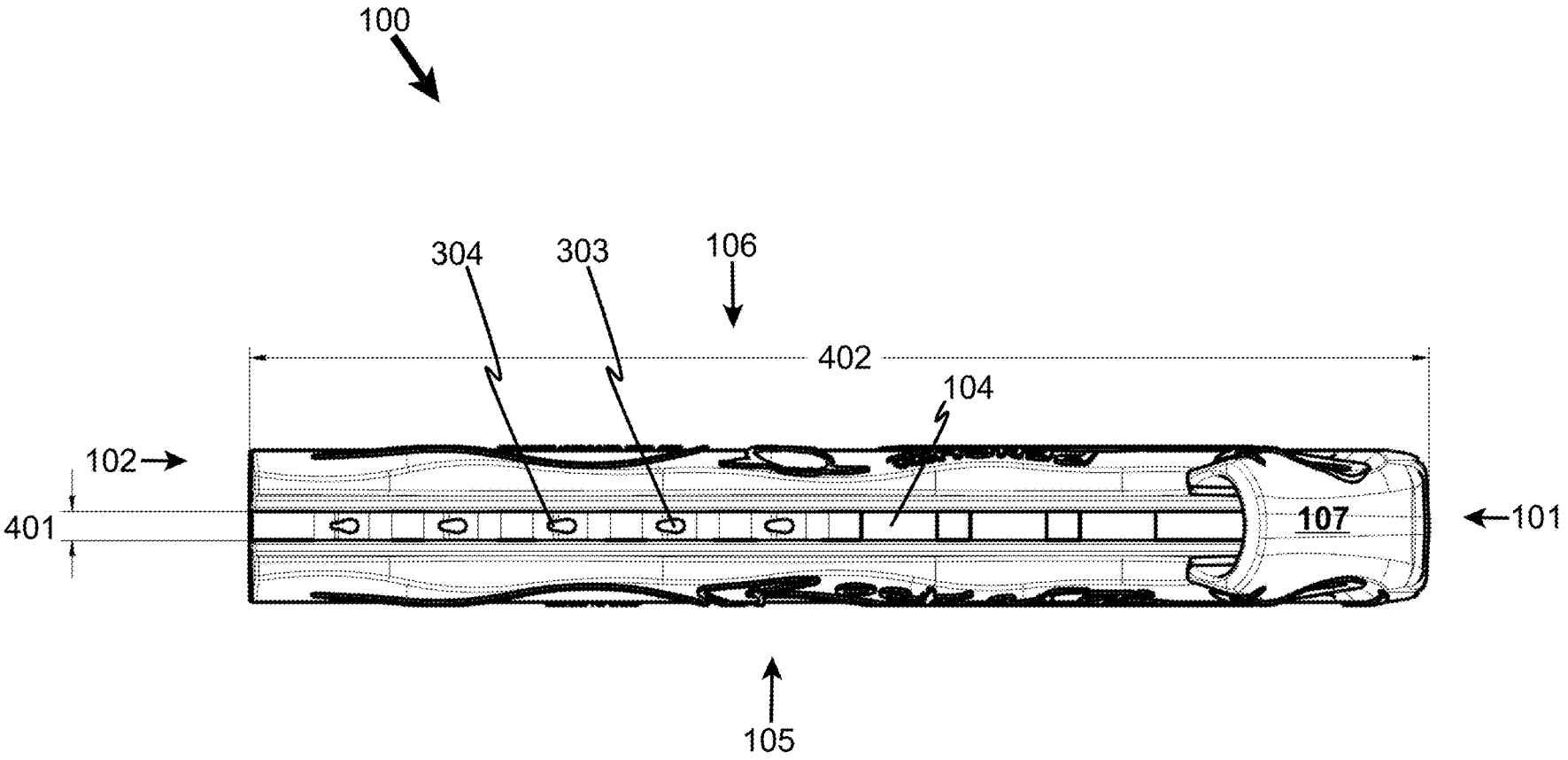
FIG. 4 provides a top-down view of an example embodiment according to the present invention.

Referring now to FIG. 4, a top-down perspective of the guard component 100 is shown, revealing the interior of the Y-channel which, in this example embodiment, has a narrow channel of about 0.170" in width 401 in the bottom of the blade receiving channel 104. Also visible from this angle are the drain top recesses 303 and channels 304. One can also see the slope of the distal wall 107 from this perspective, as well. This particular example embodiment is shown with an exterior length 402 from proximal end to distal end of about 7.017". Other shapes and dimensions are available within the spirit and scope of the present invention.

Figure 5:
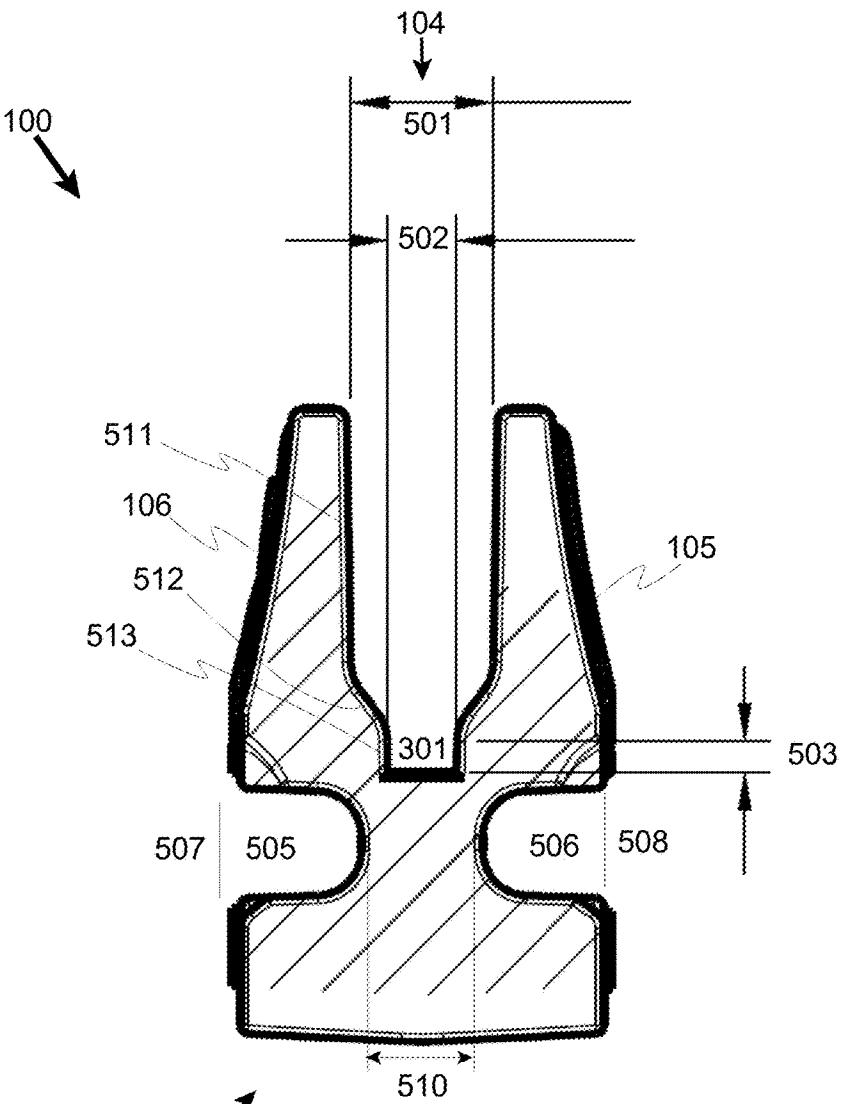
FIG. 5 shows a lateral cut-away view of an example embodiment according to the present invention.

FIG. 5 illustrates a cross-sectional view of the guard component 100 to disclose at least another improvement from the previously-disclosed designs, this one pertaining to the shape of the Y-channel bounded on an exterior of the guard by the first exterior side wall 105 and the second exterior side wall 106. In at least one embodiment according to the present invention, the guard component 100 is fabricated by molding, machining, or both, to yield a flexible, solid component. As such, the exterior side walls 105 and 106 may have a different shape on the exterior of the guard component than the shape of the interior side walls provided in the Y-channel, such as that shown. In this example, the Y-channel 104 has at least three segments. A top segment is defined by a first set 511 of opposing wall segments is at the top of the Y-channel and is the widest 501 of the segments at about 0.351" in this example embodiment. This provides for an easy entry of the blade by the wearer of the skate, allowing the greatest amount of error or wiggle while initially locating the guard onto the bottom edge of the runner. A second segment of the Y-channel is defined by a second set 512 of opposing wall segments which taper from the width of the first segment of the Y-channel down to a width 502 of the third (bottom-most) segment of the Y-channel, being about 0.170" in width as mentioned in the previous paragraph. The third segment is defined by a third set 513 of opposing interior walls, being bounded and defined by the bottom surface 301 of the Y-channel.

As such, as a wearer begins to fit and attach the guard onto a blade, typically while the skate is still on the foot of the wearer when exiting the ice arena, the blade first loosely enters the top segment of the Y-channel where it can be easily and blindly located due to the extra width of the Y-channel at this point in the attachment process. After the user has initially located the blade edge into the loose first segment of the Y-channel, the user continues to press the guard onto the blade, at which time the edge of the blade contacts one or both of the sloping walls of the second segment of the Y-channel. With continued pressure on the guard, the edge of the blade is guided or "funneled" into the narrowest (third) segment of the Y-channel, where the width is sufficiently narrow enough and the depth 503 is sufficiently deep enough to provide friction contact with the sides of the blade thereby retaining it into the slot. In this particular example, the depth of the third segment of the Y-channel is about 0.08".

To attach the guard system (two or more guard components) to a blade, after the first guard component, such as a front component, is firmly attached to the first end of the blade, the user may stretch the second component of the guard towards the other end of the blade, such as towards the heel of the skate, and attach the second guard component by pressing it on to seat the blade into the Y-channel and releasing the second guard component. At this point, the skate guard is secured onto the blade by two mechanisms—the longitudinally stretched spring and the friction of the Y-channel.

Still referring to FIG. 5, the spring-receiving channels 505 and 506 can be seen into which the springs for attaching two guard components to each other are placed and attached. In this particular example embodiment, the spring-receiving channels 505 and 506 are about 0.026" high 507, 508, and about 0.30" apart 510.

Figure 6:
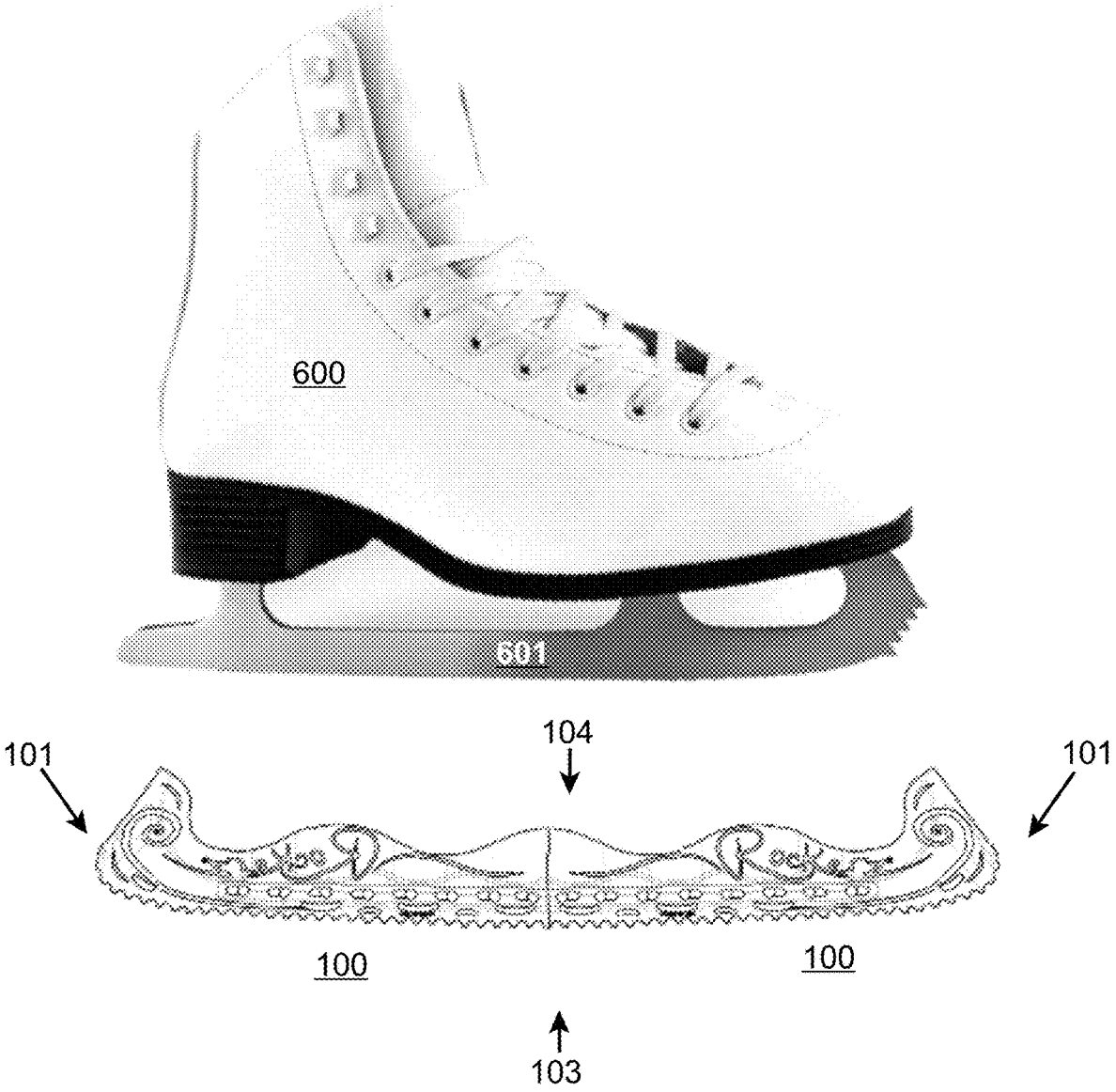
FIG. 6 illustrates a manner of using two or more guard components to yield a skate guard for a typical ice skate according to the present invention.

FIG. 6 illustrates how two similar guard components 100 can be attached at their proximal ends to yield a skate guard system, to receive a skate blade 601 into the blade receiving channel 104.

Figure 7:
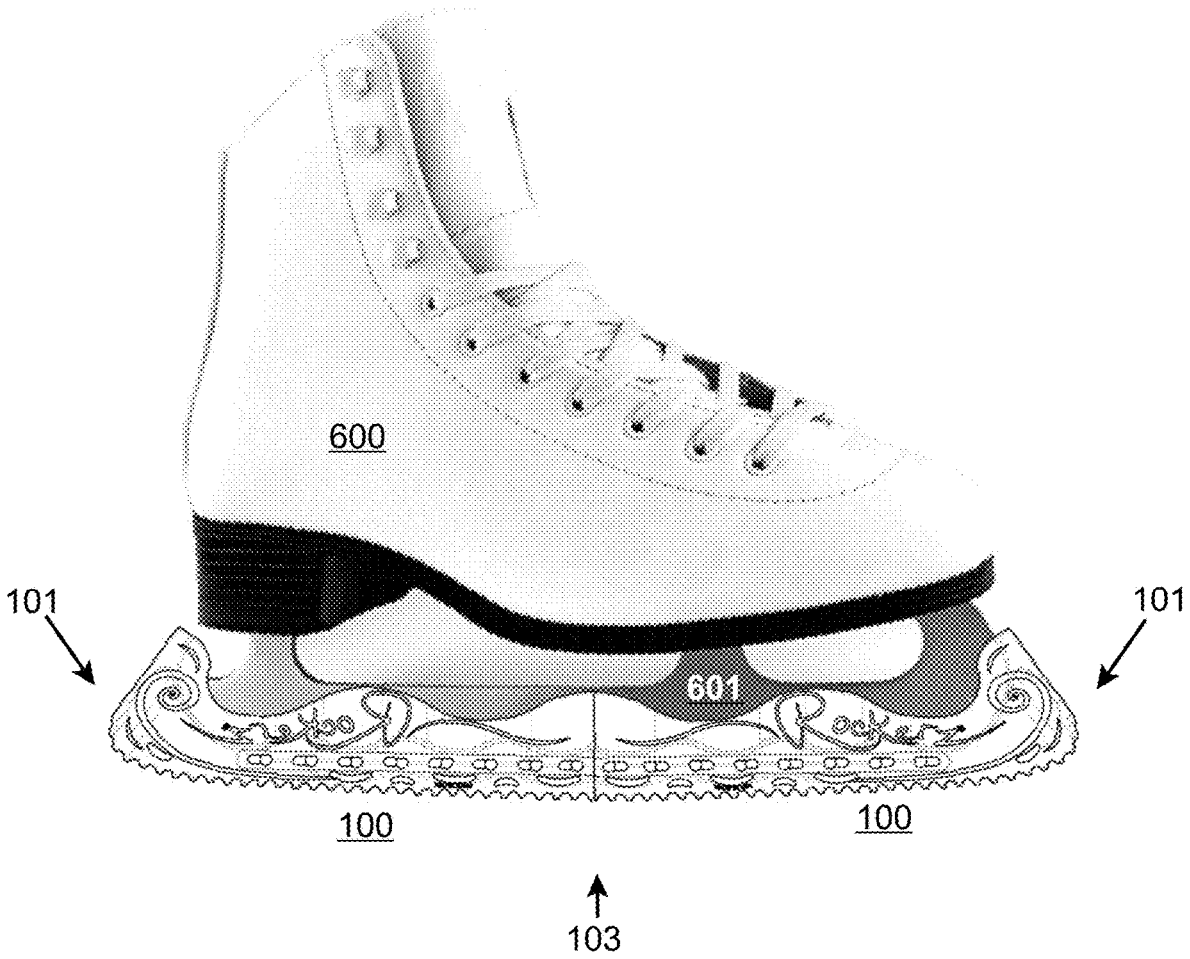
FIG. 7 further illustrates a manner of using two or more guard components to yield a skate guard according to the present invention for a typical ice skate.
Figure 8:
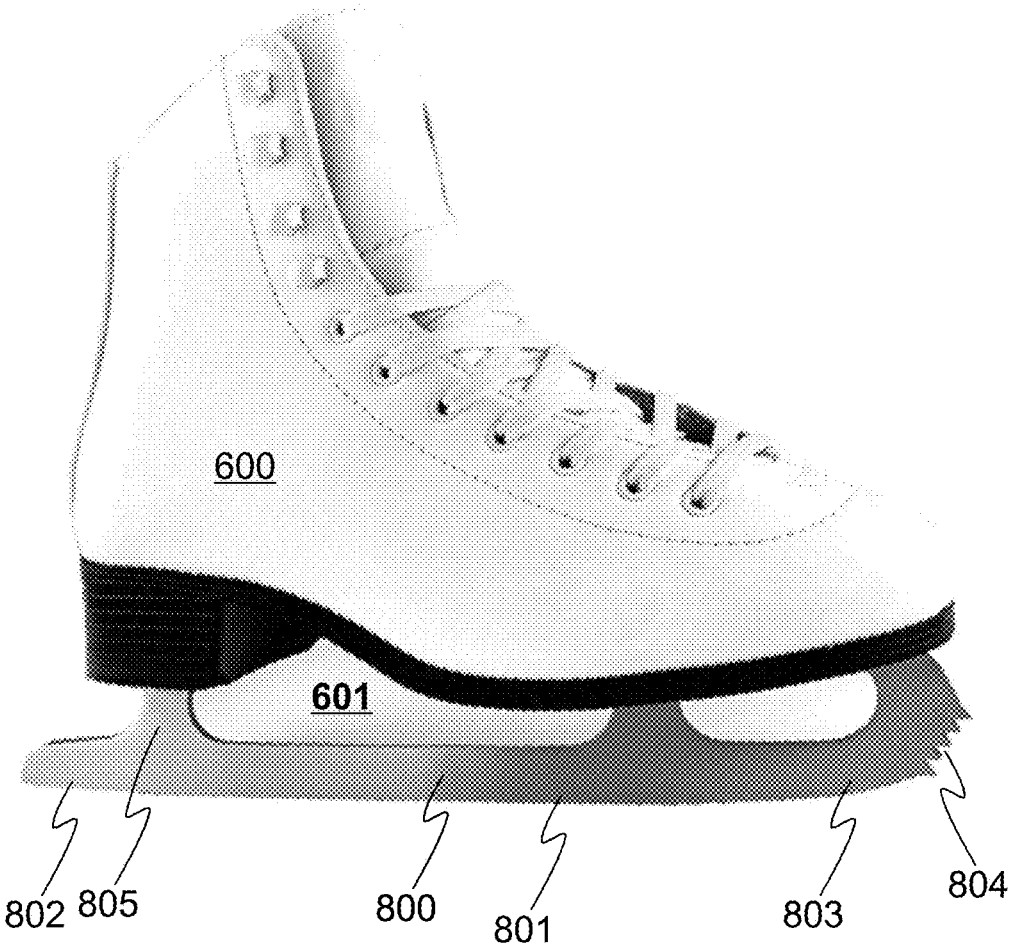
FIG. 8 provides a generalized view of a typical ice skate for reference purposes.

FIG. 7 shows such an example embodiment 100 fully attached onto a skate 600.

Further Details for Particular Improvements

Figure 9:
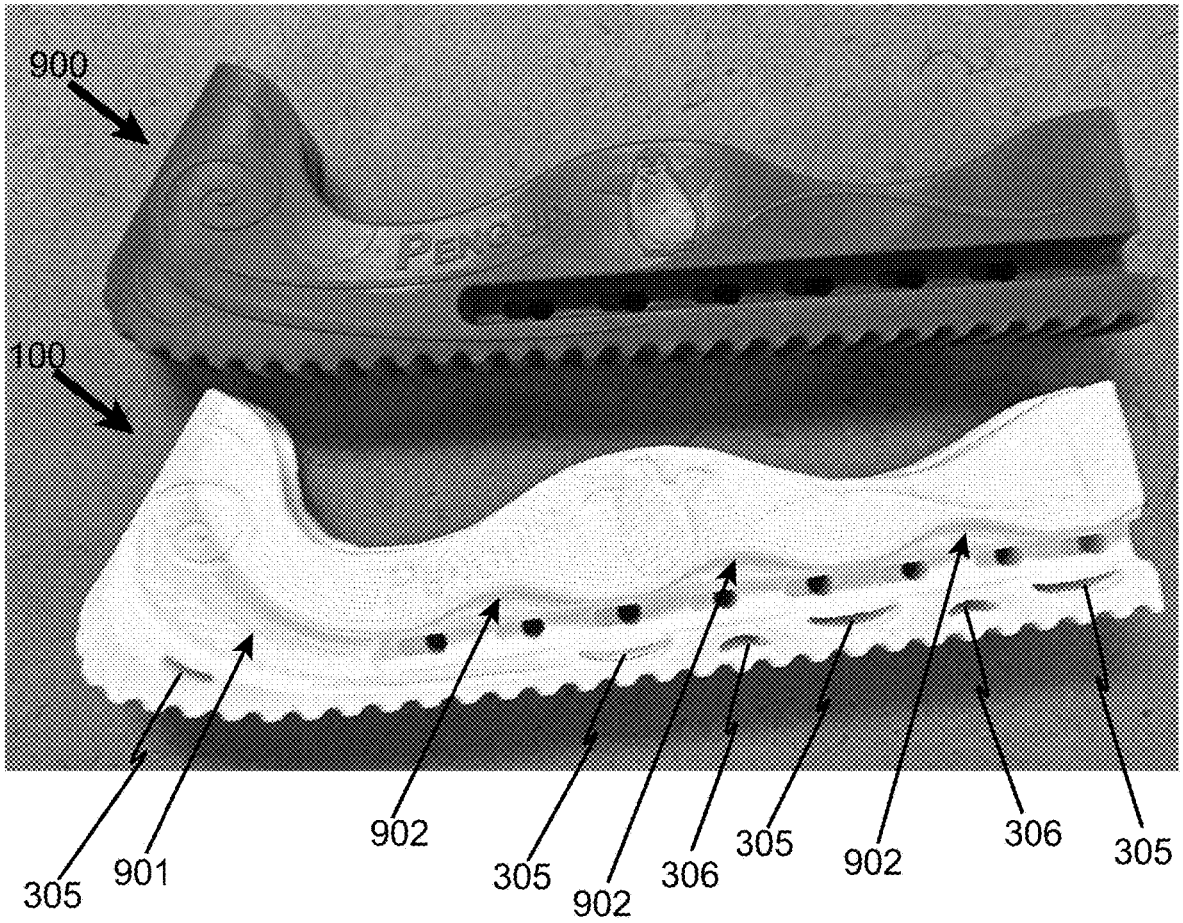
FIG. 9 provides a side-by-side photographic view of the present inventor's previous version of the skate protector product and an example embodiment improved according to the present invention, this particular view being taken from a side perspective, for ready comparison and observation of the several improvements.

Referring now to FIG. 9, the foregoing example embodiment 100 according to the present invention is shown in a photograph next to a prior product 900 by the present inventor from a side view with the distal ends of the units towards the left of the photograph. A first improvement to be noticed is the indentation 901 towards the distal end which has been added, as well as the embossed (indentations) 902 above the slot for the connector spring. Both of these features reduce the amount of plastic required to fabricate each unit, thereby reducing costs, and further enhance the curing times in the molds by maintaining a more consistent wall thickness throughout the unit, which also reduces costs (less time in the mold to yield a unit) and quality (fewer weak spots or discolored spots by maintaining material thickness). The previous unit's 900 design did not include these features.

Still further in this comparison, one can see that the drain holes 305, 306 are added to the new design and were not part of the previous product. Not only do they act as drains to discharge melted ice from the blade receiving channel 104, and also the voids that they comprise reduce the amount of plastic further to produce each unit, and they also help reduce the thickness of the material in the same area of the previous product, thereby improving costs, cure times, yield rates and quality. In some embodiments, these cored out drain vents may also act as a type of shock absorber or cushion to reduce impact to the wearer as they walk with the units on their skate blades.

Figure 10:
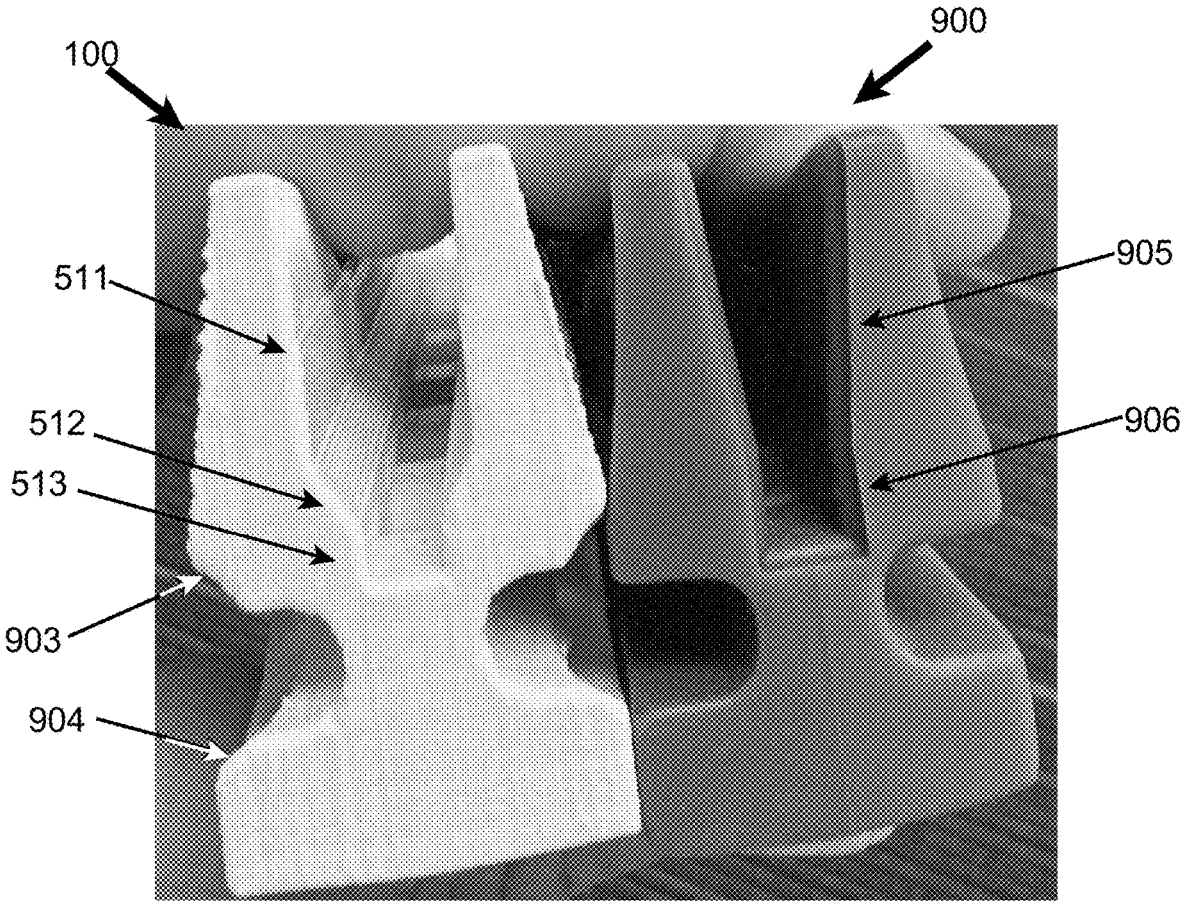
FIG. 10 provides a side-by-side photographic view of the present inventor's previous version of the skate protector product and an example embodiment improved according to the present invention, this particular view being taken from a proximal end perspective, for ready comparison and observation of the several improvements.

With reference to FIG. 10 now, the same example units are compared side-by-side from a proximal end perspective. From this angle, more improvement features can be seen in the example embodiment according to the present invention. While the spring-receiving slots or channels of the previous design had a C-shape cross-section profile, this led to extreme differences in thicknesses of the plastic material in the molds. So, for the same benefits of the indentations 901, 902 and cored out areas 305, 306, the corners of the spring-receiving slots in the example embodiment have been chamfered or beveled 903, 904. This retains the original function of the C-shaped spring slot, but reduces material required to fabricate each unit and maintains more consistent thickness of material for improved cost, curing time, yield and quality.

Still further in this comparison, one can see the differences between the two-segmented-wall V-shaped blade-receiving channel of the previous product 900 and the new three-segment Y-shaped blade receiving channel 511, 512, and 513 of the example embodiment 100 according to the present invention. This comparison makes clear the advantage of the improved channel design which is wider for a deeper segment, allowed for greater freedom of movement when putting the blade protector onto a blade, which is often down while standing on one foot and lifting the other foot to snap the protector onto the raised foot's skate blade.

Figure 11:
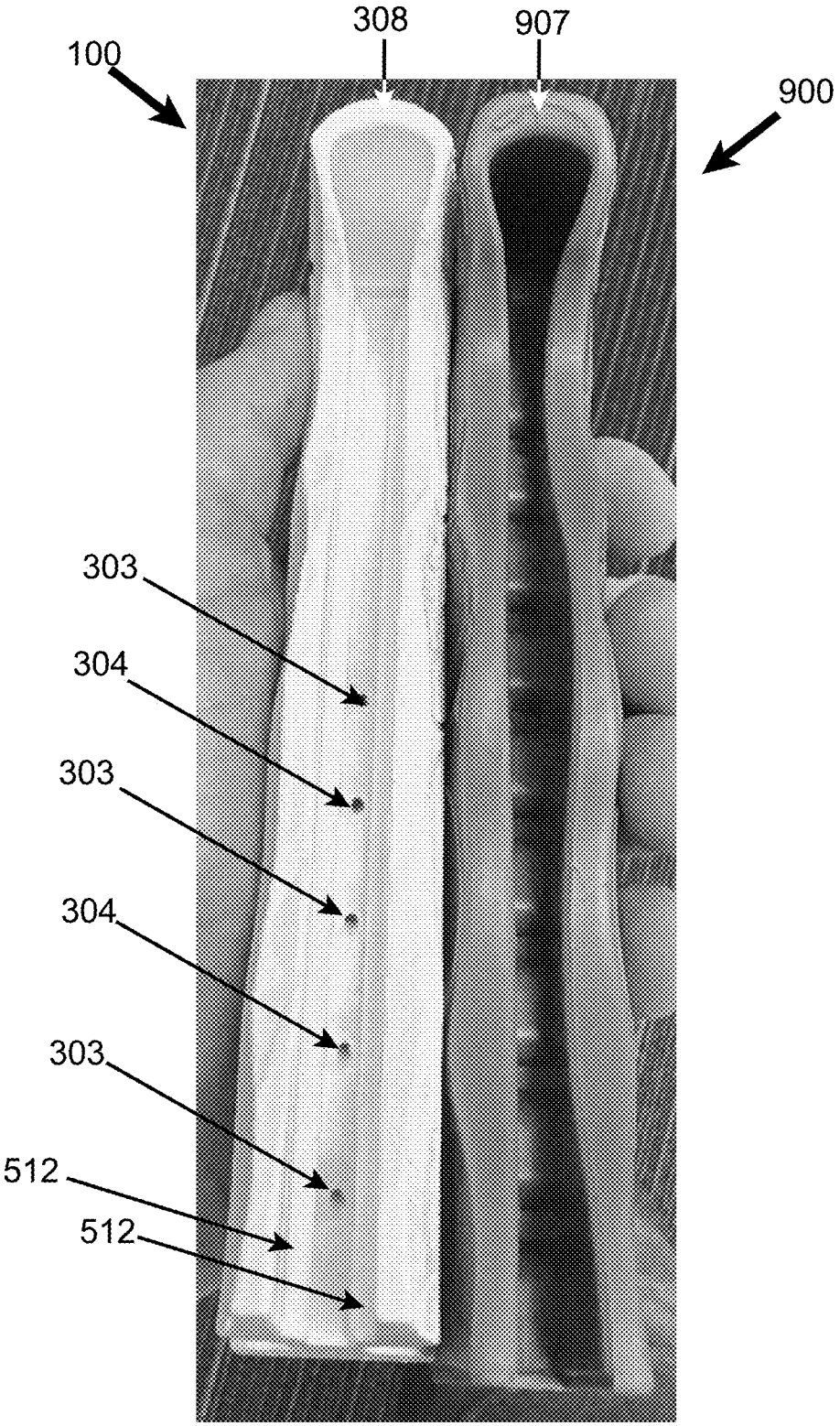
FIG. 11 provides a side-by-side photographic view of the present inventor's previous version of the skate protector product and an example embodiment improved according to the present invention, this particular view being taken from a top-down perspective, for ready comparison and observation of the several improvements.

The same example units are compared side-by-side from a top-down perspective in FIG. 11. From this angle, one can see the reduced thickness and widened opening in the improved toe-pick protector structure 308 of the example embodiment according to the present invention as compared to that 907 of the previous design, which also provides the improvements of reduction of per-unit material consumed for fabrication, decreased cure time in the most, reduced cost, and improved quality. One can also see the tops of the middle segments 512 of the new three-segment-walled Y-channels, which improves the quickness and ease of snapping the guards onto skate blades while the skates are being worn by a skater. And, from this top-down angle, one can see the new drain holes 303, 304 to remove melted ice from the blade-receiving channels, which did not exist on the prior product 900.

Improvements for Manufacturability

As can be seen from the angled view of FIG. 1 and the top down views of FIGS. 4 and 11, the example embodiment has some attractive sculpting and curve shapes that provide an artistic exterior appearance in addition to the improved utility functions of the new skate guard design. However, one should note that the sculpting shown is not just for appearances, but also provides for certain improvements in manufacturability and quality.

It is well known in the plastic injection molding and fabrication arts that molten resin may experience a number of problems as it is injected and flowed into and through a mold cavity that includes various thicknesses, voids, shapes, and volumes. Imperfections in the final product such as cold flow lines can occur due to thickening or premature solidification of the molten plastic prior to the mold's cavity filling completely. Cure cycles may be extended due to overly thick portions of the item taking much longer than thinner portions to solidify, thereby slowing production rates and increasing costs. Where mold cavity thicknesses vary, a hesitation effect may occur in which the molten resin moves preferentially into the thicker (larger) voids leaving thinner areas empty or filled later or even non-filled areas, thereby causing a variety of cosmetic and potentially quality (strength, hardness, elasticity, etc.) issues in the final product. Overpack refers to a similar possibility of molds with varying thicknesses in which the preference of the molten resin to fill the larger voids first can lead to warping of the final item.

Due to these challenges, the present skate guard includes surface shapes and contours which are not only attractive and distinctive for brand recognition, they also manage the cross sectional area of the skate guard component to be essentially consistent as the resin flows lengthwise (longitudinally) into the mold. For example, when there is a particular void at a particular point in the longitudinal structure, such as a void for a drain vent, this reduction of cross sectional area of the mold at this point is offset by a thickening or thinning of the wall just above or below the vent. In this manner, the resin finds essentially consistent resistance or conductivity to flow at every point along the length of the mold, except for the pick guard tip, of course. According to at least one embodiment of the present invention, such as the embodiment illustrated, a plurality of sculpted indentations and projections on exterior surfaces of the skate guard component compensate the fabrication material volume to offset changes in fabrication volumes for one or more voids, cuts, curves and angles in the skate guard component such that cross-sectional fabrication material area remains essentially constant during longitudinal flow of resin, thereby enhancing plastic molding operations by minimizing thereby improving costs, cure times, yield rates and product quality.

Improved Fastener Retainer

As can be seen in FIGS. 2 and 3, according to another improvement of the present invention, some embodiments may have one or more fastener receiving holes 204 with a retainer feature to allow the user to insert a threaded fastener (bolt, screw, etc.) without it easily falling out of the hole when the user tips or rotates the guard to apply a nut or other securing element to the end of the fastener.

For example, if springs are used to attach the segments of the skate guard together, the ends of the springs may be secured to the skate guard components using a threaded bolt and nut. The hole cored out of the plastic molded product may be formed with a short, straight side (i.e., secant), as shown, such that the threads of the bolt can be pushed through the hole while slightly engaging the secant side without requiring rotating of the bolt to pass it through the hole. Then, when the user tips or rotates the skate guard component to attach a nut onto the end of the bolt, the bolt is kept from falling out of the hole, thereby allowing easier and quicker assembly.

Multi-Segment Embodiment

There is an embodiment of the present invention which allows for a greater degree of customization, especially with respect to colors. In a skating environment, such as a practice or a competition, many skaters may have removed their skate guards and left them on the ground, near chairs or benches, or tucked under bags, etc. For a first objective, skaters would like to be able to quickly identify which skate guards are their own, such as by color. While the foregoing description of example embodiments allows for a wide array of one-color (front and back sections match in color) and two-color (front section is a different color than the back section) combinations, the number of combinations are finite. For a second objective, some skaters may wish to use 3 or more colors in order to match colors of a team, state, university, country or other personal representation, such as red, white and blue, or green, black and red, or even an approximation of a rainbow.

The presently disclosed and illustrated segmented design lends itself to assembling skate guards using two, three or more segments of different colors, either at the factory, dealer or by the end user.

Figure 12:
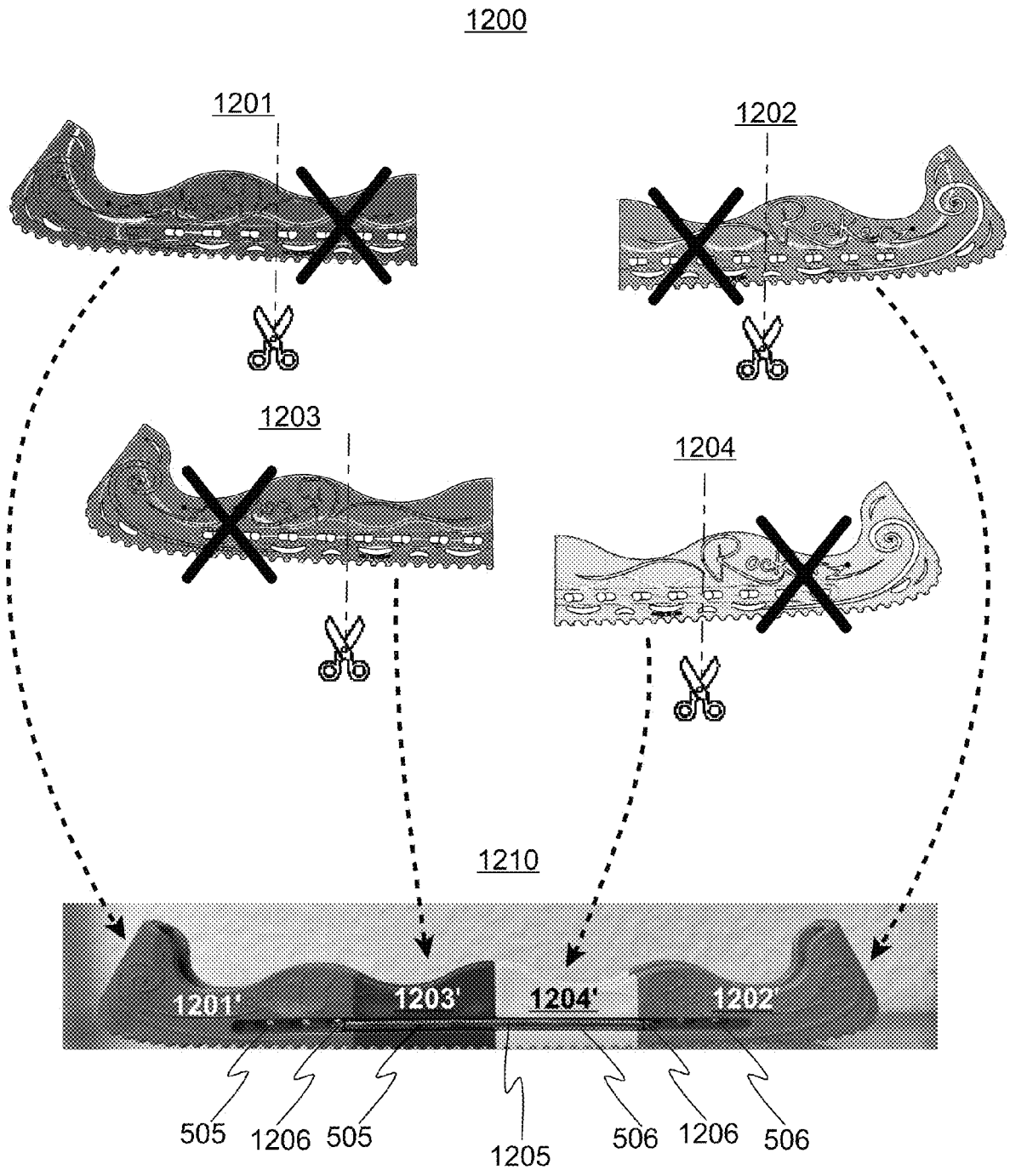
FIG. 12 illustrates a multi-segment, multi-color embodiment as well as a method of assembly for a skate guard, both according to the present invention.

Referring now to FIG. 12, a method of manufacturing 1200 a multi-segment embodiment is shown which illustrates the method of assembly of any combination of two or more segments to achieve a skate guard assembly having one, two, three or more colors. In this color drawing, a first half-guard 1201, such as a blue unit, can be cut into two segments as illustrated along the dashed line denoted by a scissors icon. In reality, the cutting is likely done with a saw or knife in most embodiments due to the consistency of the materials, but a scissors icon is used here for illustrative purposes. A portion 1201' of the first skate guard is used in the final assembly 1210, as indicated by the dashed arrow lines.

Likewise, one or more additional half-guard units 1202, 1203, and 1204, are cut to yield three more segments such as green 1202', purple 1203', and yellow 1204' for assembly into multi-segment, multi-color skate guard 1210. The assembly 1210 is held together by a one or more springs 1205 received into the spring slots 505 and 506, and secured at either end, such as by one or more screws, fasteners, rivets, and/or posts.

In its normal state, the spring(s) 1205 is (are) slightly stretched, thereby providing a front-to-back compressive force pulling the end segments 1201' and 1202' towards each other, thereby capturing any center segments such as 1203' and 1204' between the end segments, and holding all the segments in linear alignment. When putting the guard onto a skate blade or removing it from a skate blade, the user pulls the front or rear segment away from the rest of the guard assembly, thereby opening the skate blade channel in a lengthwise fashion to allow entry or exit of the blade from the channel. Any center segments remain captured by the one or more springs in their spring slots during attachment and removal to and from a skate blade.

The unused segments (shown by the large X's) in this example process 1200 may be discarded, returned to the manufacturer for plastic recycling, or kept for use in future skate guard assemblies. In this manner, skate guards can be easily and quickly assembled with two, three or more segments, and the segments may all be the same color or may be of a variety of colors. Further, due to spring-in-channel alignment design, the segments may be of varying lengths or of equal lengths, providing for a nearly infinite number of combinations of colors and stripe patterns. While a preferred embodiment uses springs for the alignment and retention force, other resilient stretchable devices and materials may be used such as rubber bands, elastic strips, and stretchable tubing, some of which may offer certain advantages such as decreased weight, color options, and avoidance of rust or metal corrosion.

Curve-Conforming Track Embodiment

According to at least one embodiment of the present invention, the skate guard is configured to curve and adapt to a curved bottom edge of a skate blade. Such curvature can be seen in FIGS. 6 and 7. This can be achieved using one or more design features, the first of which is selection of a plastic material which is hard enough to capture the skate blade and support the weight of the wearer, but soft enough to flex along the tread of the skate guard as the wearer walks and rolls their weight from the heel to the center and to the toe of the skate. A second feature is to use a plurality of segments as described in the foregoing paragraphs, forming a multi-segmented tread similar to that of a tractor, wherein the linking spring allows each segment to assume a slightly different angle of support on the curved bottom edge of the skate blade, if it is curved.

Conclusion

The terminology used herein is for the purpose of describing particular exemplary embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof, unless specifically stated otherwise.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. An improved skate guard, wherein the skate guard has a plurality of exterior surfaces and a skate blade receiving channel defined within the skate guard, the improvement comprising one or more drains formed in a bottom surface of the skate blade receiving channel to an exterior of the skate guard component, wherein a top opening of at least one of the one or more drains is provided with a recess below the bottom surface of the skate blade receiving channel defining a volume into which ice and ice shavings are received and held.

2. The improved skate guard of claim 1 wherein at least one drain is provided with a vent formed into at least one exterior side of the skate guard which is in liquid communication with a lower end of the at least one drain.

3. The improved skate guard of claim 2 wherein the vent comprises a void formed transversely across a width of the skate guard component, thereby allowing draining of liquid from within the skate blade receiving channel to either or both exterior sides of the skate guard component.

4. The improved skate guard of claim 3 wherein the transversely formed vent void comprises a shape which is crushable under a predetermined amount of weight or force, thereby providing a shock absorber and cushion to reduce impact to a wearer during walking with the skate guard component attached to a skate blade.

5. An improved pick guard for a skate guard, wherein the skate guard has at least two side walls essentially parallel to each other, and a skate blade receiving channel defined within the two side walls and a bottom surface, the improved pick guard comprising:

a rounded lower tip disposed at a distal end of the skate guard and in direct mechanical connection to the bottom surface at a bottom portion of the rounded lower tip, and extending transversely across a width of the skate guard between the two side walls; and a distal wall disposed at a top portion of the of the rounded lower tip, and extending transversely across a width of the skate guard between the two side walls;

wherein distal slopes wall slopes from the rounded lower tip towards a proximal end of the skate guard component with a similar shape being provided on an interior of the distal wall, thereby configured to capture a pick guard, toe or heel of a skate blade when attached.

6. The improved pick guard of claim 5 wherein the shape provided on the interior of the distal wall defines a capturing channel of about 0.170" wide.

7. The improved pick guard of claim 5 wherein the distal wall forms a sloping angle with the rounded lower tip of about 59 degrees.

8. The improved pick guard of claim 5 further comprising one or more drains formed in the interior of the distal wall, or in an interior of the rounded distal tip, or in both, wherein the one or more drains are configured to conduct liquid from the skate blade receiving channel to an exterior of the skate guard component.

* * * * *